United States Patent [19]

Bernardino

[11] 4,297,251

[45] Oct. 27, 1981

[54] PROCESS FOR REMOVING HARD-TO-REMOVE SOILS FROM HARDWARE

[75] Inventor: Lowell W. Bernardino, Cincinnati, Ohio

[73] Assignee: The Procter & Gamble Company, Cincinnati, Ohio

[21] Appl. No.: 792,966

[22] Filed: May 2, 1977

[51] Int. Cl.[3] ..... C11D 1/12; C11D 7/44

[52] U.S. Cl. ..... 252/545; 252/547; 252/548; 252/550; 252/551; 252/554; 252/555; 252/558

[58] Field of Search ..... 252/545, 547, 548, 550, 252/551, 554, 555, 558, DIG. 14, 153

[56] References Cited

U.S. PATENT DOCUMENTS

| | | | |
|---|---|---|---|
| 2,773,835 | 12/1956 | Anderson | 252/153 |
| 3,069,361 | 12/1962 | Cogswell | 252/363.5 |
| 3,793,233 | 2/1974 | Rose et al. | 252/547 |
| 3,819,523 | 6/1974 | Bove | 252/89 |
| 3,900,421 | 8/1975 | Fusey | 252/312 |
| 3,928,249 | 12/1975 | Nunziata et al. | 252/526 |
| 3,944,663 | 3/1976 | Weiss et al. | 424/78 |
| 3,957,971 | 5/1976 | Oleniacz | 424/70 |
| 3,963,649 | 6/1976 | Spadini et al. | 252/546 |
| 4,040,989 | 8/1977 | Renaud et al. | 252/548 |

FOREIGN PATENT DOCUMENTS

| | | |
|---|---|---|
| 45-68528 | 8/1970 | Japan . |
| 48119550 | 10/1973 | Japan . |

OTHER PUBLICATIONS

*Cosmetics, Science and Technology,* 2nd Ed., Sagarin et al., Interscience (1957–1972), p. 89.

*The Chemistry and Manufacture of Cosmetics,* 2nd Ed., De Navarre, copyright 1941–1962, Van Norstrand, pp. 238–239.

*Primary Examiner*—P. E. Willis, Jr.

*Attorney, Agent, or Firm*—Robert B. Aylor; Richard C. Witte; Thomas H. O'Flaherty

[57] ABSTRACT

Stable, single-phase light duty, anionic detergent compositions having a pH of from about 7 to about 9 and containing a vegetable lecithin detergency boosting ingredient which improves the removal of baked on and hard-to-remove soils from housewares, including pots and pans, dishes, glasses, utensils, etc. Process for washing dishes with said compositions. Process for the preparation of said compositions.

2 Claims, No Drawings

PROCESS FOR REMOVING HARD-TO-REMOVE SOILS FROM HARDWARE

BACKGROUND OF THE INVENTION

The present invention relates to stable, single-phase light-duty, anionic liquid detergent compositions. Such compositions contain synthetic anionic surfactants; normally, a suds boosting ingredient; the vegetable lecithin; perfume; and an aqueous solvent. They may also contain minor ingredients and a minor amount of conventional detergent builders. They have a pH which is from about 7 to about 9.

Numerous examples of such light duty liquid detergent compositions can be found in the art including U.S. Pat. Nos. 3,332,874; 3,332,877; 3,332,879, 2,970,964; 2,970,963; 3,179,599; 3,179,598; 3,211,661; and 3,793,233, said patents being incorporated herein by reference. Similar compositions are disclosed in the copending U.S. patent application, Ser. No. 669,531, filed Mar. 23, 1976 of Hellyer et al, entitled, "DETERGENT COMPOSITIONS CONTAINING SEMI-POLAR NONIONIC DETERGENT AND ALKALINE EARTH METAL ANIONIC DETERGENTS", said application being incorporated herein by reference. The present invention relates to improvements of the light duty liquid detergent compositions disclosed in the aforementioned patents and application. Although such light duty liquid compositions are excellent for the intended purpose, the present invention constitutes an improvement on such compositions.

Lecithin has been used at low levels, e.g., less than about 0.6% in light duty liquid detergents as an emollient and has been suggested for use in shampoos, believed to be soap based shampoos, as a suds stabilizer and emollient at levels of 2 to 5%. Egg lecithin has been suggested for use in shampoos as part of "egg shampoo" formulas.

SUMMARY OF THE INVENTION

The present invention relates to a stable, single-phase, light duty liquid detergent composition consisting essentially of:

(a) from about 5% to about 35% of a synthetic anionic surfactant having the formula $$R—(Y)_n—(O)_nSO_3M$$

wherein R is an alkyl group containing from about 8 to about 24 carbon atoms which can be either straight or branched chain, saturated or unsaturated and attached either at the terminal position, a secondary position, or random attachment or mixtures thereof; Y is a group selected from the group consisting of $(OC_2H_4)_x$ wherein x is a number from 1 to 30; $(O—CH_2—CHOH-Ch_2)_m$ wherein m is a number from 1 to 3; or a benzene ring; each n is either 0 or 1; and M is selected from the group consisting essentially of sodium, potassium; mono-, di-, or tri-alkanolammonium wherein the alkanol groups contain from 2 to 4 carbon atoms; mono-, di-, or tri-alkylammonium wherein the alkyl groups contain from 2 to 4 carbon atoms; ammonium; magnesium; calcium; or mixtures thereof;

(b) from 0% to about 15% of a suds boosting ingredient selected from the group consisting of amine oxide surfactants and amide surfactants;

(c) from 0.8% to about 5% of a vegetable lecithin detergency boosting ingredient;

(d) from 0% to about 20% of a detergency builder; and, (e) water, the pH of the composition being above about 7 and less than about 9.

DETAILED DESCRIPTION OF THE INVENTION

The individual components of the instant detergent compositions are described in detail below.

THE ANIONIC SURFACTANT

The anionic synthetic non-soap detergents utilized herein can be broadly described as the water soluble salts, particularly the alkali metal salts of organic sulfuric acid reaction products having in their molecular structure an alkyl radical containing from about 8 to about 20 carbon atoms and a radical selected from the group consisting of sulfonic acid and sulfuric acid ester radicals. Specific examples include the sodium or potassium alkyl sulfates obtained by sulfating the higher alcohols ($C_8$–$C_{18}$ carbon atoms) produced by reducing the glycerides of tallow or coconut oil; sodium or potassium alkyl benzene sulfonates in which the alkyl group can be a straight or branched chain which contains from about 9 to about 15 carbon atoms in the alkyl group; sodium alkyl glyceryl ether sulfonates, especially those ethers of the higher alcohols derived from tallow and coconut oil; the sodium or potassium salts of sulfuric acid esters of the reaction products of one mole of a higher fatty alcohol (e.g., tallow or coconut oil alcohols) and from one to 30 moles of ethylene oxide. Other suitable anionic surfactants include olefin sulfonates having from about 12 to about 24 carbon atoms. The term "olefin sulfonate" is used here to mean compounds which can be produced by the sulfonation of alpha-olefins and is prepared by means of uncomplexed sulfur trioxide follow by neutralization of the acid reaction mixture using conditions such that the sultones which have been formed in the reaction are hydrolyzed to give the corresponding hydroxyalkylene sulfonates. The sulfur trioxide may be liquid or gaseous and is usually, but not necessarily, diluted by inert diluents, for example by liquid $SO_2$, chlorinated hydrocarbon, etc. when used in the liquid form, or by air, nitrogen, gaseous $SO_2$, etc. when used in the gaseous form. Alpha olefins which can be used include 1-dodecene, 1-tetradecene, 1-hexadecene, etc. Other suitable anionic surfactants include paraffin sulfonates containing from 8 to 18 carbon atoms. Preferred mixtures are those described in the U.S. patents and patent application referred to hereinbefore and are incorporated herein by reference. The anionic surfactants provide the main detergency benefit for these compositions and are responsible for the good sudsing characteristics of these compositions. Preferably the compositions will contain from about 10 to about 30 percent of the anionic surfactant, most preferably from about 15 to about 30 percent by weight of the surfactant. All parts, ratios, percentages, etc. herein are by weight unless otherwise specified.

THE NONIONIC SUDS BOOSTER

The nonionic suds boosters of this invention include semi-polar, nonionic detergents such as the tertiary amine oxides corresponding to the general formula $$R^1—(OR^2)_{n'}—N(R^3)_2 \rightarrow O$$

in which $R^1$ is an alkyl radical of from about 8 to about 18 carbon atoms; $R^2$ is an alkylene or a hydroxy alkylene group containing 2 to 3 carbon atoms; $n^1$ ranges from 0 to about 20; and each $R^3$ is selected from the group consisting of methyl, ethyl and hydroxyethyl radicals and mixtures thereof. The arrow in the formula is a conventional representation of a semi-polar bond. Specific examples of amine oxide detergents include dodecyldimethylamine oxide, tridecyldimethylamine oxide, tetradecyldimethylamine oxide, pentadecyldimethylamine oxide, hexadecyldimethylamine oxide, heptadecyldimethylamine oxide, octadecyldimethylamine oxide, dodecyldiethylamine oxide, tetradecyldiethylamine oxide, hexadecyldiethylamine oxide, octadecyldiethylamine oxide, dodecyldipropylamine oxide, tetradecyldipropylamine oxide, hexadecyldipropylamine oxide, octadecyldipropylamine oxide, dodecyldibutylamine oxide, tetradecyldibutylamine oxide, octadecyldibutylamine oxide, bis(2-hydroxyethyl) dodecylamine oxide, bis-(2-hydroxyethyl)-3-dodecoxy-1-hydroxypropylamine oxide, (2-hydroxypropyl) methyltetradecylamine oxide, dimethyl-(2-hydroxydodecyl)amine oxide, 3,6,9-trioxoctadecyl dimethylamine oxide and 3-dodecoxy-2-hydroxy propyl di(2-hydroxyethyl-)amine oxide.

Another suds boosting nonionic surfactant is an organic carboxylic acid amide.

Such amide compounds include those aliphatic amides of the general formula:

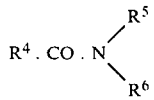

wherein $R^4$ is alkyl, or alkylol and $R^5$ and $R^6$ are each hydrogen, $C_2$–$C_4$ alkyl, $C_2$–$C_4$ alkylol, or $C_2$–$C_4$ alkylenes joined through an oxygen atom, the total number of carbon atoms in $R^4$, $R^5$ and $R^6$ being from about 9 to about 25.

Amides of this general type which are of special utility are those aliphatic carboxylic acid alkanolamides of the formula:

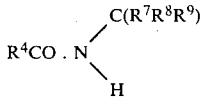

in which RCO is the acyl group of a soap-forming carboxylic acid having from about 10 to about 18 carbon atoms, $R^7$ and $R^8$ are each selected from the group consisting of hydrogen, $C_1$–$C_2$ alkyl, and $C_0$–$C_2$ alkylol substituents, and $R^9$ is an alkylol substituent, the total number of carbon atoms in $R^7$, $R^8$ and $R^9$ being from 1 to 7.

Some specific amides coming within the scope of the invention are:

lauric ethanolamide;
stearic ethanolamide;
dimethyl lauramide;
lauramide;
lauryl lauramide;
myristic N-methyl ethanolamide;
butyl capramide;
capric butanolamide;
dibutyl capramide;
dibutyl myristamide;
stearic acid amide of tri(hydroxymethyl) amino methane;
myristic glycerylamide;
N-lauroyl morpholine;
lauric glycerylamide;
palmitic acid amide of 2-amino-2-methyl-1,3-propanediol;
lauryl hydroxy-acetamide;
myristyl formamide;
lauric isopropanol amide; and
myristic acid amide of 3-amino-3-methyl-2,4-pentanediol.

Especially preferred is tallow acyl monoethanolamide.

Such amides, and their preparation are discussed more fully in U.S. Pat. No. 2,527,076, hereby incorporated by reference.

Preferred amounts of nonionic suds booster are from 2% to about 10%, more preferably from about 3% to about 7%.

THE DETERGENCY BOOSTING INGREDIENT

Vegetable lecithins, and especially soybean lecithin, are commercially available materials. The term "lecithin" is the commercial or popular name for a mixture of naturally-occurring compounds. The principal compounds in the mixture are lecithin and cephalin. As used herein, soybean lecithin refers to the commercial mixtures and purified fractions thereof, including modified compounds containing at least one long-chain fatty acid moiety in addition to the phosphate ester moiety. Especially preferred compounds are those wherein one of the fatty acid moieties, which naturally occurs in, e.g., soybean lecithin, is removed or is replaced with a shorter chain, e.g., carboxylic acid, moiety.

Although it is generally believed that lecithins are relatively unstable in compositions containing large amounts of water, it has surprisingly been found that in the compositions of this invention, the soybean lecithin maintains its stability and activity even after storage without an additional preservative. Under accelerated conditions, e.g., 120° F., the compositions can use a preservative such as diethylene triamine pentaacetic acid to maintain good color and odor after about eight days.

The amount of lecithin present in the formula will vary depending upon the type of lecithin used. In general, from about 0.8% to about 5%, preferably from about 1% to about 3%, most preferably from about 1% to about 2% lecithin is used. The purer the material, the less lecithin is used and the more effective the lecithin becomes. Also, the more water soluble is the particular lecithin, the more effective it is.

It has surprisingly been discovered that the lecithin boosts the detergency of the compositions of this invention when they are used for washing housewares such as pots, pans, utensils, glasses, dishes, etc. where hard-to-remove baked-on soils are commonly encountered. In general, one will use as much of the lecithin as is possible without creating an unstable detergent composition.

Above a pH of about 8.5, the formulas tend to develop an off-odor directly attributable to the lecithin. Below a pH of about 7.5, many formulas are unstable with the composition splitting into two phases.

It has been found, surprisingly, that although lecithin, amine oxides, and amides have been suggested as suds stabilizers, the combination of amine oxides and/or diethanol amides, especially amine oxides, with lecithin gives improved sudsing, both as to quantity and stability over what one would have expected, especially in the presence of soils.

THE MINOR INGREDIENTS

In addition to the main ingredients, it may be also desirable to have an organic water soluble solvent present such as an alcohol or glycol containing from 2 to about 4 carbon atoms or glycerine in an amount of from about 1% to about 15%, preferably from about 3% to about 10%. These solvents help to compatibilize the other organic ingredients when the other ingredients are present at higher levels.

It may also be desirable to include coloring agents, opacifiers, perfumes, corrosion inhibitors and small amounts of heavy metal chelating agents such as citric acid salts, ethylenediaminetetraacetic acid salts, etc.

Preferably the compositions of this invention do not aontain calcium or magnesium since they cause some difficulties in providing a stable single-phase system. ıimilarly, it is desirable that the compositions not conıain added fatty materials which act as a load on the detergency effects of these compositions. Also, desirably there should not be too much soap present, to avoid raising the pH.

The compositions can also contain small amounts, less than about 20%, preferably less than about 1%, of detergency builders. Normally such builders will not present. Desirable builders include citrates, carbonates, orthophosphates, and pyrophosphates. Preferably the compositions do not contain phosphate builders. Other suitable builders are disclosed in U.S. Pat. Nos. 3,932,316 and 3,929,678, incorporated herein by reference.

Preferably the compositions will not contain proteolytic enzymes or builders for mildness reasons. Also, preferably the compositions will not contain any, and certainly not large amounts, e.g., >1%, of other surfactants, especially amphoteric and zwitterionic surfactants, since it is desirable to limit the cost of the compositions. It is a benefit of the vegetable lecithin that improves detergency of "hard-to-remove" soils even at low levels.

The compositions of this invention are normally used in water at levels of from about 0.1% to about 0.5% to remove "hard-to-remove" soils from housewares.

The following examples demonstrate this invention.

EXAMPLE I

| Composition | 1 | 2 |
|---|---|---|
| Sodium coconut alkyl sulfate | 12.5 | 12.5 |
| Sodium coconut alkyl polyethoxylate (3) sulfate | 13.5 | 13.5 |
| Coconutalkyldimethylamine oxide | 4.0 | 4.0 |
| Potassium chloride | 1.0 | 1.0 |
| Ethanol | ~7.0 | ~7.0 |
| Hydrogen peroxide | 0.01 | 0.01 |
| Perfume | ~0.3 | ~0.3 |
| NaOH/HCl | ←trim→ | |
| Soybean lecithin | 0 | 1 |
| Water | ←Balance→ | |
| pH | 8 | 8 |

The above compositions were tested as follows. Aluminum and Pyrex 2-½"×4" slides (coupons), and coated with three different soils which were baked on or dried on. The first soil was prepared by blending 90 grams of lean ground beef with 200 cc of 70° F. distilled water, one egg, 15 grams of flour and 57 grams of Hunts Tomato Sauce for 20 minutes (beef soil). The second soil was macaroni and cheese prepared by emptying the contents of a Franco American Macaroni and Cheese can, ¼ cup milk, and 200 gms. of Velveeta Cheese into a blender and blending for one minute. The third soil was air dried egg yolk. These soils were baked or dried to give soils visually comparable to that achieved under normal cooking conditions. The air-dried soil was dried overnight. The soils were applied, using 2 cc of each soil, as six round spots on Pyrex, aluminum and Pyrex.

The coupons were cleaned with a detergent solution containing 0.4% product concentration (4 gms.) in 1000 ml. of 115° F. water with the hardness adjusted to 2 to 7 grains. The beef soil and egg soil were soaked for ten minutes and the macaroni and cheese soil was soaked for five minutes before cleaning. The coupons were then wiped with a sponge an equal number of times and graded for soil removal by a panel of three judges. Two replicates were run for each soil in each test and the scores were generated using the Scheffe grading scale. The results were as follows.

| Composition | 1 | 2 |
|---|---|---|
| (2 grain water) | | |
| Beef soil | −1.12 | 0.04 |
| Macaroni and cheese | −0.66 | 0.66 |
| Egg | −0.33 | 0.71 |
| (7 grain water) | | |
| Beef soil | −0.75 | 0.58 |
| Macaroni and cheese | −0.62 | −0.33 |
| Egg | −0.04 | −1.08 |

As can be seen from the above table, the composition which contains the detergency improving materials removes the soils better (more positive scores) and more readily than the same composition without the detergency improving materials.

EXAMPLE II

| Composition | 1 | 2 | 3 | 4 | 5 | 6 |
|---|---|---|---|---|---|---|
| Sodium coconut alkyl sulfate | 12.5 | 12.5 | 12.5 | 12.5 | 12.5 | 12.5 |
| Sodium coconut alkyl polyethoxylate (3) sulfate | 13.5 | 13.5 | 13.5 | 13.5 | 13.5 | 13.5 |
| Coconut alkyl dimethyl amine oxide | 4.0 | 4.0 | 4.0 | 4.0 | 4.0 | 4.0 |
| Potassium chloride | 1.0 | 1.0 | 1.0 | 1.0 | 1.0 | 1.0 |
| Sodium citrate | 0.0 | 0.0 | 0.0 | 0.0 | 0.0 | 0.0 |
| Ethanol (approximate level) | 7.0 | 7.0 | 7.0 | 7.0 | 7.0 | 7.0 |
| Hydrogen peroxide | 0.1 | 0.1 | 0.1 | 0.1 | 0.1 | 0.1 |

EXAMPLE II-continued

| Composition | 1 | 2 | 3 | 4 | 5 | 6 |
|---|---|---|---|---|---|---|
| Perfume (approximate level) | 0.23 | 0.23 | 0.23 | 0.23 | 0.23 | 0.23 |
| NaOH/HCl | ← | ← | ←trim→ | | → | → |
| Soybean lecithin | 0 | 1 | 2 | 3 | 4 | 5 |
| Water | ← | ← | ←balance→ | | → | → |
| pH | 8 | 8 | 8 | 8 | 8 | 8 |

The above compositions provide improved cleaning of hard-to-remove soils from housewares as compared to the equivalent compositions without the lecithin. Compositions containing an equivalent amount of the following materials in place of the citrate also are improved by the lecithin: sodium cyclohexane hexacarboxylate; ammonium cyclopentane tetracarboxylate; potassium tetrahydrofuran tetracarboxylate; monoethanolammonium polyacrylate; diethanolammonium pentane hexacarboxylate; potassium pyrogallol; sodium adipate; sodium gluconate; ammonium mucate; potassium mellitic acid pentacarboxylate; sodium oxylate; ammonium oxydiacetate; sodium malonate; sodium tartrate; and 1:1 mixtures thereof.

In the above compositions, the specific amides and amine oxides disclosed hereinbefore and 1:1 mixtures thereof can be substituted on an equal weight basis for the amine oxide of this example. Similarly, the specific anionic surfactants and detergency boosting ingredients disclosed hereinbefore and 1:1 mixtures thereof can be substituted on an equal weight basis for the respective anionic surfactants and detergency boosting ingredients of this example.

What is claimed is:

1. The process of removing hard-to-remove soils from housewares including pots, pans, dishes, glasses and utensils using aqueous solutions containing from about 0.1% to about 0.5% of a stable, single-phase light duty liquid detergent composition consisting essentially of:

(a) from about 5% to about 35% of a synthetic anionic surfactant having the formula $R—(Y)_n—(O)_n-SO_3M$ wherein R is a group containing from 8 to about 24 carbon atoms which can be either straight or branched chain, saturated or unsaturated and attached either at the terminal position, a secondary position, or random attachment or mixtures thereof; Y is a group selected from the group consisting of $(OC_2H_4)_x$ where x is a number from 1 to 30; $(O—CH_2—CHOH—CH_2)_m$ wherein m is a number from 1 to 3; or a benzene ring, each n is either 0 or 1; and M is selected from the group consisting essentially of sodium; potassium; mono-, di-, or trialkanolammonium wherein the alkanol groups contain from 2 to 4 carbon atoms; mono-, di-, or trialkylammonium wherein the alkyl groups contain from 2 to 4 carbon atoms; ammonium; magnesium, calcium; or mixtures thereof;

(b) from 0% to about 15% of a suds boosting ingredient selected from the group consisting of amine oxide surfactants and amide surfactants;

(c) from 0.8% to about 5% of a detergency boosting ingredient which is a vegetable lecithin; and, (d) water, the pH of the composition being above about 7.5 and less than about 8.5.

2. The process of claim 1 wherein the detergency boosting ingredients is soybean lecithin.

* * * * *